United States Patent [19]

Wirz et al.

[11] 3,956,986

[45] May 18, 1976

[54] INKING SYSTEM FOR PRINTING MACHINES

[75] Inventors: Burkhardt Wirz; Peter Decker, both of Munich, Germany

[73] Assignees: Roland Offsetmaschinenfabrik Faber & Schleicher AG; Grapho Metronic GmbH & Co., both of Germany

[22] Filed: Dec. 4, 1974

[21] Appl. No.: 529,526

[30] Foreign Application Priority Data

Dec. 5, 1973 Germany ..... 2360611

[52] U.S. Cl. ..... 101/350; 137/39; 101/148

[51] Int. Cl.² ..... B41F 31/00

[58] Field of Search ..... 101/148, 348, 350, 363, 101/170, 207, 208, 210, 214; 137/39; 165/14, 19, 22, 26; 72/201

[56] References Cited

UNITED STATES PATENTS

| | | | |
|---|---|---|---|
| 2,260,364 | 10/1941 | Case | 101/350 X |
| 2,334,628 | 11/1943 | Huck et al. | 101/350 X |
| 2,971,460 | 2/1961 | Shindle | 101/348 X |
| 2,972,301 | 2/1961 | Gessler et al. | 101/350 X |
| 2,994,514 | 8/1961 | Brown | 165/26 |
| 3,141,408 | 7/1964 | Bernardi et al. | 101/426 |
| 3,191,668 | 6/1965 | Lorenz | 165/22 |
| 3,688,696 | 9/1972 | Treff | 101/350 |
| 3,741,115 | 6/1973 | Keller | 101/350 X |
| 3,847,209 | 11/1974 | Mascall | 165/14 |
| 3,848,664 | 11/1974 | Perry et al. | 165/22 |

*Primary Examiner*—E. H. Eickholt

*Attorney, Agent, or Firm*—Wolfe, Hubbard, Leydig, Voit & Osann, Ltd.

[57] ABSTRACT

An inking system for applying ink to a printing plate which includes a fountain roller and a series of ink feed rollers with at least one vibrated roller or drum. Means are provided for automatically regulating the temperature of the fountain roller thereby to maintain constant the amount of ink fed over a long press run for maintenance of a predetermined full tone density. Means are also provided for automatically regulating the temperature of the vibrated roller thereby to maintain constant the printing contrast in the half tone portions of the plate. The temperature regulating means includes both a source of heat and a source of cold, making it possible to either warm or cool the rollers thereby permitting automatic operation over a wide range of conditions including a wide variation in the ambient temperature. In the preferred embodiment the temperature of the rollers is maintained by circulating a fluid such as water through the rollers from a reservoir of fluid at a controlled rate and temperature. Means are additionally provided for applying to the rollers a "shot" of fluid which is selectively either hot or cold to bring the rollers rapidly to desired temperature prior to turning on the automatic regulating means. In one embodiment of the invention the temperatures of the fountain roller and vibrated roller are independently regulated by supplying them with fluid from separate reservoirs having provision for separate temperature regulation.

15 Claims, 3 Drawing Figures

INKING SYSTEM FOR PRINTING MACHINES

It has been known in the past that temperature has a major effect upon the printing process, the temperature depending upon ambient conditions and also upon heat build-up during long press runs. U.S. Pat. No. 2,260,364 describes an inking system in which the fountain and inking rollers are intentionally heated in order to be able to use inks that are capable of flowing only at a high temperature. German Pat. No. 1,179,225 teaches the heating of an ink film on a roller at a thermostatically maintained temperature. It is proposed in German Auslegeschrift No. 1,611,233 that heat build-up during a long printing run may be counteracted by cooling the rollers in the vicinity of the plate cylinder.

However, our studies show that prior heating and cooling schemes are not capable of maintaining constant printing conditions, particularly in the face of long press runs. We have found that it is desirable to separately maintain a constant regulated temperature both at the ink fountain and at the vibrated roller, or rollers. A regulated temperature at the fountain roller tends to maintain constant the amount of ink which is fed per unit time past the fountain blade, and hence the ink density in the full tone areas of the printing plate. Maintaining the vibrator rollers at regulated temperature is found to have a different but supplemental effect, namely, the maintenance of a predetermined printing contrast in the screened or half tone areas of the printing plate, to prevent dot gain or dot loss.

It is, accordingly, an object of the present invention to provide an inking system in which the temperature at the fountain roller and the temperature at the vibrated roller, or rollers, are both regulated so as to produce consistent and optimum printing in the full tone areas and half tone areas of a printing plate in spite of long press runs and over a wide range of conditions, including conditions in the press itself as well as ambient temperature conditions.

It is a more specific object of the present invention to provide an inking system for a printing press in which the temperature of the fountain roller and vibrated roller roller is maintained constant by circulating through the rollers a fluid such as water derived from a fluid reservoir which is maintained at a desired temperature using both heat and refrigeration, alternatively, and with the heat and refrigeration being switched on correctively in accordance with a thermostat responsive to the temperature of the fluid which is discharged from the rollers.

It is a more specific object to provide an inking system for a printing press which not only includes means for constantly and automatically regulating the temperature of the fountain roller and vibrated rollers but which includes provision for manually applying a "shot" of heat or a "shot" of cold in the form of hot or cold fluid, with constant monitoring of temperature, for bringing the rollers quickly to the desired operating temperature, following which the system may be turned over to automatic regulation.

It is an object of the invention in one of its aspects to provide a temperature control system including a pump for pumping liquid at controlled temperature through the rollers and in which automatic means are provided for turning off the pump when the press slows down to a predetermined speed and for turning on the pump when the press is restored to operating speed.

It is a still further object to provide a temperature control system for the rollers in a printing press which is especially desirable for presses of the lithographic type permitting maintenance of temperature at a level which is sufficiently low as to inhibit the evaporation of water from the plate due to heat build-up in extended operation, which in turn produces a paper deposit on the blanket cylinders. As a result washing intervals may be greatly extended.

Other objects and advantages of the invention will become apparent upon reading the attached detailed description and upon reference to the drawings in which.

While the invention has been described in connection with certain preferred embodiments, it will be understood that we do not intend to limit the invention to the particular embodiments shown but intend, on the contrary, to cover the various alternative and equivalent forms of the invention included within the spirit and scope of the appended claims.

Figure 1:
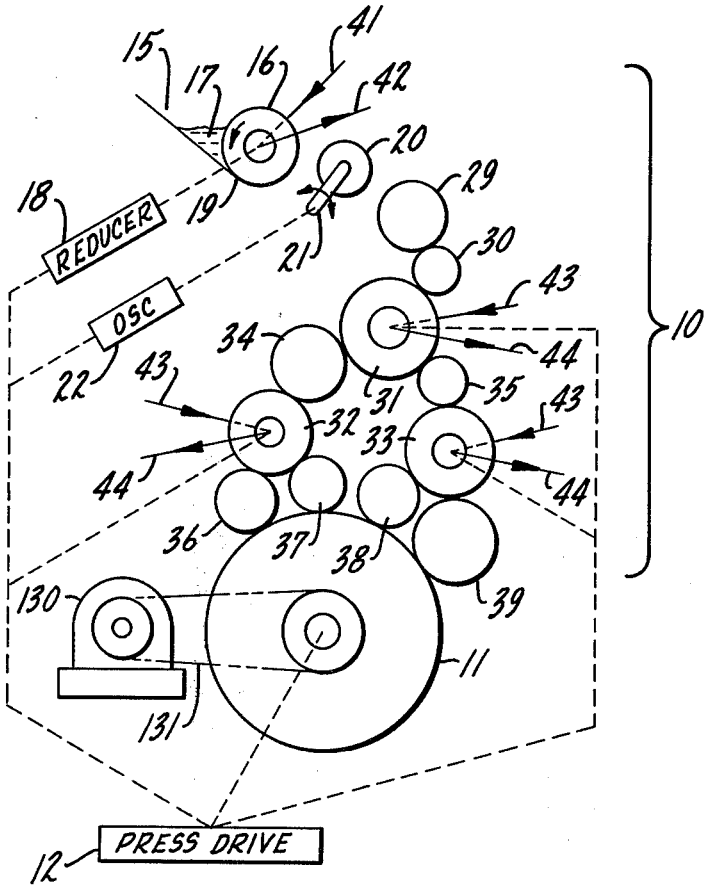
FIG. 1 is a diagram showing a typical ink feed system employed in a printing press and to which the invention has been applied.

Turning now to FIG. 1 there is shown an inking system 10 for inking a printing plate (not shown) upon a plate cylinder 11. The plate cylinder is rotated by a press drive 12, and it will be understood that such cylinder is used with the usual blanket and impression cylinders which, for the sake of simplicity, have not been shown. The inking system 10 includes a fountain 15 having a fountain roller 16 rotating in contact with a body of ink 17. As the ink fountain roller 16 slowly rotates in the direction shown, being driven from the press drive through a speed reducer 18, a film of ink is formed on the surface of the roller by means of a fountain blade 19. The fountain blade has the usual provision for point-to-point adjustment of the film thickness along the length of the blade.

For the purpose of picking off a portion of the film for transfer to the remainder of the inking system, a well-known type of ductor roller 20 is used mounted upon a pair of oscillating arms 21 which are rocked by an oscillating mechanism, generally indicated at 22, driven by the press drive 12. The usual means (not shown) may be provided for determining the duration of "dwell" of the ductor 20 against the surface of the fountain roller 16.

The film of ink is transferred via rollers 29, 30 into a smoothing arrangement which includes vibrated rollers in the form of hollow reciprocating drums 31, 32, 33, rubber rollers 34, 35 being interposed as shown. From the oscillated rollers ink is conveyed to the plate of the plate cylinder by a set of four form rollers 36–39, inclusive. The vibrated rollers, or drums, 31–33 have separate driving connections to the press drive, which have been indicated diagrammatically, for the purpose of reciprocating the rollers endwise while driving them at press surface speed.

In carrying out the present invention the fountain roller 16 and the vibrated rollers 31–33 are of hollow metallic construction having fluid connections 41, 42 and 43, 44 at the respective ends, the fluid connections being conventional and of the "slip" type. The connections 41, 43 receive fluid via a supply line 45 whereas the connections 42, 44 discharge into a common return line 46. Flow into, and out of, the lines 45, 46 is under control of a first selector valve 50 having inlet connections 51, 52, 53 from which fluid is selectively fed to a common outlet connection 54 by means of a slidable valve plunger 55. Associated with the return line 46 is a similar selector valve 60 having outlet connections 61, 62, 63 to which fluid is selectively fed from a common inlet connection 64 under the control of a valve plunger 65. The valve plungers are bridged together for movement in unison via a connection 66. It will be understood that means (not shown) are provided for biasing the plungers into their illustrated central or "normal" positions. The operation will be discussed with the valve plungers in such normal positions, following which means will be described for moving the plungers, under manual control, to respective shifted positions.

For the purpose of furnishing fluid to the supply line 45, a fluid reservoir 70 is provided having selectable sources of heat and cold. The source of heat is preferably a heating element 71 having a supply connection 72 used for control purposes. The source of cold is a cooling coil 73 which is connected to a refrigeration unit indicated generally at 74 which is capable of circulating refrigerant through the coil 73 under the control of a control device 75 which receives its instructions from an electrical control line 76. For the purpose of pumping fluid from the reservoir 70 into the bodies of the rollers, a fluid pump 80 is used driven by a motor 81 to which current is supplied via a line 82 and selector switch 83 from a suitable current source 84. Under normal conditions the switch 83 is closed.

For the selective energization of the heating coil 71 and cooling coil 73, a thermostatic regulator is provided having a double-throw switch. While the present invention is not limited to any particular form of thermostatic regulator, we have illustrated a regulator 90 of the bulb and bellows type. The regulator includes a bulb 91 which is thermally coupled to the return line 46 and which is connected by a capillary 92 to a bellows 93. The bellows 93 is mechanically coupled to a movable switch contact 94 which is selectively engageable with a "heat" contact 95 and a "cold" contact 96. The "heat" contact 95, as shown, supplies the heating element 71 through line 72, while the "cold" contact 96 is connected to the refrigeration controller 75 through line 76. For the purpose of manually setting the equilibrium temperature of the regulator, the bellows 93 may be mounted upon a movable base 97 which is positioned by a cam 98 under the control of a manual setting knob 99.

In accordance with one of the aspects of the invention the flow of fluid into the two branches of the system may be differentially adjusted by means of throttle valves 101, 103. Such valves may take many different forms and may, in the simplest aspect, be a pivoted manually settable vane for partially throttling the flow so that the fluid arriving in the supply line 45 is divided in predetermined ratio. Separate means are provided for monitoring the outlet temperatures in lines 42, 44. In the simplest form, such monitors may be in the form of thermometers 102, 104 thermally coupled to the respective lines. Since the throttle valves 101, 103 by controlling the flow differentially affect the regulated values of temperature in the fountain and vibrated rollers, respectively, such valves form an effective part of the regulator 90.

In reviewing the operation of the system as thus far described, it will be understood that the switch 83 is manually closed, thereby energizing the motor 81 which drives the pump 80 and energizing the contact 94 in the regulator 90. The fluid impelled by the pump thus flows through valve 50, through line 45 and valves 101, 103 into the two branches of the system. The outlets discharge into a common return line 46 which returns the fluid through selector valve 60 back to the reservoir 70. It will be assumed that at the outset the temperature is below the desired equilibrium temperature set by the knob 99 so that contact is made between contacts 94 and 95, thereby energizing the heating coil 71. This heats the fluid in the reservoir until the fluid in the return line reaches the desired equilibrium temperature, at which time the heating element is turned off. In the event that the temperature of the returned fluid should exceed the equilibrium value, the bellows expands causing a circuit to be made through contacts 94, 96 with the result that the control unit 75 turns on the refrigerator 74 to circulate refrigerant through the cooling coil 73 to bring the temperature back down to the equilibrium level. The "dead band" between the contacts 95, 96 is sufficiently wide to avoid overtravel or hunting. In this way, any departure of the temperature in the return line from the desired temperature produces immediate corrective action.

The effect of the above is to keep the ink on fountain roller 16 at such a constant temperature that, with the fountain blade left at a constant setting, the same thickness of ink is deposited on the fountain roller in spite of changes in ambient temperature and in spite of the frictional working of ink in the ink fountain during long press runs, both changes tending to affect ink viscosity. Consequently, the same amount of ink per unit time will be transported by the ductor and the same amount of ink per unit time will reach the printing plate, so that the density of the ink in the full tone, or solidly printing, areas of the plate will remain constant. The effect of the above is also to keep the ink on the vibrated rollers 31–33 at such a constant temperature that the same viscosity ink is deposited at all times on the "dots" which make up the screened half tone areas of the plate, regardless of changes in ambient temperature and regardless of the frictional working of the ink on the ink rollers, with consequent heat build-up, during long press runs. Thus printing quality is optimized and made uniform in both full tone and half tone areas. Since the optimum temperature at the fountain is close to the optimum temperature at the vibrated rollers, the temperature may be maintained constant by using a single regulated reservoir 70, with localized adjustment being obtainable by use of differentially adjustable throttle valves 101, 103 adjusted in accordance with the readings of monitoring thermometers 102, 104.

In accordance with one of the aspects of the present invention means are provided for bringing the system to the equilibrium temperature at an accelerated rate as required, for example, in starting up the press. In short, means are provided for manually applying a "shot" of heat or a "shot" of cold. Turning first to the auxiliary heating system indicated at 110, it includes a reservoir 111 having a source of heat 112 connected to a current source 113. For pumping fluid from the reservoir 111 a pump 114 is used mechanically connected to a motor 115 which is energized by a manual switch 116. Connected to the switch via a line 117 is a "heat" solenoid 118 having an armature or plunger 119.

Similarly an auxiliary source of cold 120 is used having a cold reservoir 121 including a cooling coil 122 supplied from a refrigeration unit 123. Cold fluid is pumped by a pump 124 driven by a motor 125 under the control of a switch 126. The switch, in addition, serves to energize a control line 127 leading to a "cold" solenoid 128 having an armature or plunger 129.

Thus when a "shot of heat" is desired, switch 116 is temporarily closed (switch 83 being opened). Closure of the switch 116 applies voltage to line 117 which energizes solenoid 118 so that the valve plungers 55, 65 are drawn to the right, thereby establishing a fluid connection to supply line 45 through valve port 52 and a fluid connection to return line 46 via port 62 in valve 60. At the same time closure of switch 116 turns on the motor 115 to drive pump 114 so that fluid at relatively high temperature is furnished to the fountain roller 16 and vibrated rollers 31–33. Switch 116 is maintained closed until the monitoring thermometers 102, 104 indicate that the temperature is approaching the desired equilibrium level. At such time switch 116 is opened and switch 83 is closed so that the automatic temperature regulator 90, previously described, takes over control.

In the event that the temperature of the rollers is initially too high so that rapid refrigeration is necessary, switch 126 is closed, applying voltage to line 127 thereby energizing solenoid 128 so that the valve plungers are drawn to the left, thereby connecting the cold reservoir 121 to the rollers via valve ports 53, 63. Closure of switch 126, energizing motor 125, drives pump 124 so that fluid from the cold reservoir 121 is directly circulated into the rollers of the ink system. Again, when the temperature indicated by the monitoring thermometers 102, 104 indicates that the desired equilibrium temperature is approached, switch 126 may be opened and switch 83 closed so that fluid is thereafter supplied to the rollers from the regulated reservoir 70. The use of separate pumps 80, 114, and 124 enables delivery to be tailored to the need and to the reservoir capacity.

Figure 2:
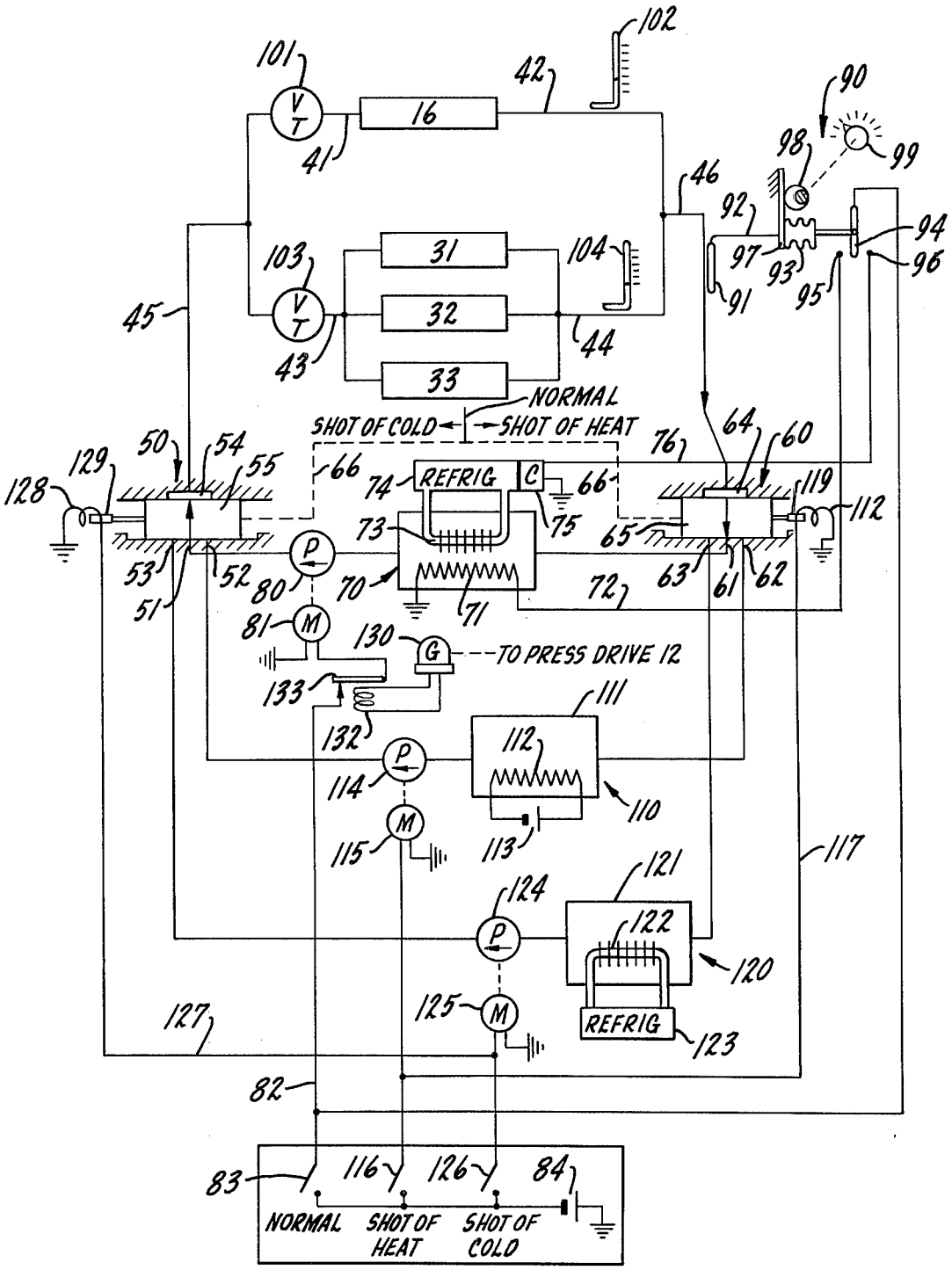
FIG. 2 shows an automatic temperature regulating system for the fountain roller and vibrated rollers in FIG. 1, with provision for accelerated application of heat and cold, the system being shown in simplified diagrammatic form.

It is one of the features of the present invention that the pump 80 in the regulated system is automatically turned off when the speed of the press drops to below a predetermined operating level. Such automatic turn off is achieved in the present instance by a tachometer generator 130 (see FIGS. 1 and 2) which is driven from the regular press drive 12 by a belt 131 or the like. The output voltage from the tachometer generator is fed into the coil 132 of a relay having a set of normally open contacts 133 connected in series with the motor 81. As illustrated in FIG. 2, the press is at operating speed so that the contacts 133 are closed, permitting normal operation of the motor. However, in the event that the press drive 12 drops substantially below operating speed, the voltage from the tachometer generator is no longer sufficient to hold the contacts 133 closed so that the motor circuit opens to shut off the pump 80. However should the press speed rise again to near rated level, the relay 132 will be re-energized, reclosing the contacts 133 to again turn on the pump. Such automatic shut-off and re-start enables the controlled rollers to maintain a surface temperature during shutdown and reduced speed running which corresponds more nearly to normal running conditions.

It will be apparent, then, that the system shown in FIG. 2 is capable of maintaining the fountain roller and vibrated rollers at a predetermined equilibrium temperature which is optimum for the ink being used, which temperature is constantly and automatically maintained. That is to say, the temperature maintained at the fountain roller is such as to insure that the amount of ink being fed past the fountain blade will remain constant regardless of changing conditions thereby to maintain a predetermined density in the ink in the full tone areas of the printing plate. At the same time, the vibrated rollers, or drums, 31–33 are maintained at their optimum temperature so that the printing characteristics of the ink are kept constant with the result that the printing contrast remains the same in the half tone areas of the printing plate, notwithstanding a change in the operating or ambient conditions and in spite of long press runs.

In the embodiment discussed above differential adjustment of the throttle valves 101, 103 feeding the two portions of the system is relied upon to establish divided flow, thereby to create separate optimum conditions of temperature in the two branches. However in accordance with one of the aspects of our invention means may be provided for separate regulated control of the fountain roller on the one hand and of the vibrated rollers, or drums 31–33 on the other. Such a dual system is disclosed in FIG. 3, in which corresponding reference numerals are employed to indicate corresponding parts with addition of subscript *a* or subscript *b* in the respective halves of the circuit. One difference between the circuit of FIG. 3 and that shown in FIG. 2 is that the circuit of FIG. 3 has a common reservoir for furnishing a "shot" of heat and a common reservoir for furnishing a "shot" of cold for achieving the desired equilibrium temperature at an accelerated rate, the shared elements carrying a subscript *c*.

Figure 3:
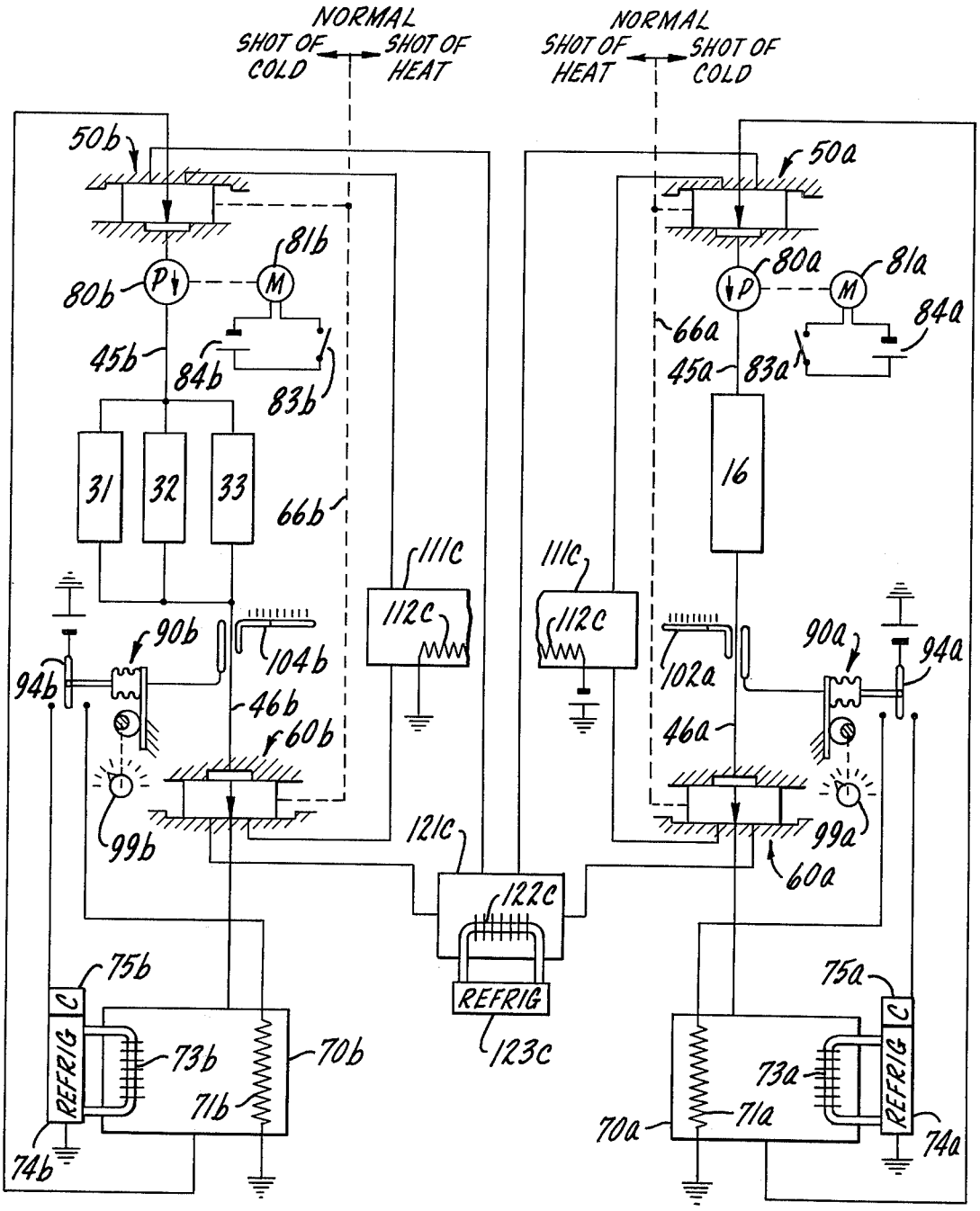
FIG. 3 is a diagram showing a modified form of the invention in which two separately regulated systems are employed to control the temperatures of the fountain and vibrated rollers.

The operation in FIG. 3 is otherwise the same as in FIG. 2. Taking the right-hand portion of the circuit which supplies regulated fluid to fountain roller 16, turning on switch 83*a* starts pump 80*a* to begin circulation of the fluid. The temperature of the fluid in return line 46*a* is measured by the bulb of the regulator 90*a*, causing the controlled contact 94*a* to either turn on the heating coil 71*a* or the cooling coil 73*a*, as appropriate. To apply a "shot", of heat the plungers of valves 50*a*, 60*a* are shifted to the left, temporarily connecting the hot reservoir 111*c* to the fountain roller, with the temperature being monitored by a thermometer 102*a*. The selector valve plungers are restored to central position when the monitored temperature approaches the equilibrium level to restore automatic control. Conversely, if the fountain roller is initially too warm, requiring refrigeration, the plungers of selector valves 50*a*, 60*a* are moved to the right to connect into the circulation circuit the cold reservoir 121*c*.

The identical mode of control is achieved in the left-hand portion of the circuit which furnishes fluid at a separately regulated temperature to the vibrated rollers 31–33. Here again a "shot" of heat may be obtained by moving the plungers of valves 50*b*, 60*b* to the right and a "shot" of cold by moving them to the left.

While a rudimentary on-off form of regulator has been illustrated in FIGS. 2 and 3 to simplify the showing of the invention, it will be understood that more elaborate "proportioning" regulators may be used without departing from the invention.

What we claim is:

1. In an inking system for applying ink to a printing plate in a printing press, the combination comprising a fountain including a fountain roller, a series of ink feed rollers including at least one vibrated roller, the fountain roller and vibrated roller being of hollow metallic construction having fluid supply and return lines, a fluid reservoir having an alternatively energizable source of heat and source of cold, a pump for pumping fluid through the supply and return lines, regulator means for correctively energizing the source of heat and source of cold to maintain a predetermined temperature condition in the rollers, means including an adjustable throttling valve means for dividing the fluid flow in predetermined ratio between the fountain roller and vibrated roller so that the temperature at each of the rollers is maintained at a predetermined relative level, and means for indicating the temperatures in the respective return lines to facilitate adjustment of the valve means.

2. In an inking system for applying ink to a printing plate in a printing press, the combination comprising a fountain including a fountain roller, a series of ink feed rollers including at least one vibrated roller, the fountain roller and vibrated roller being of hollow metallic construction having fluid supply and return lines, a fluid reservoir having an alternatively energizable source of heat and source of cold, a pump for pumping fluid through the supply and return lines, regulator means for correctively energizing the source of heat and source of cold to maintain a predetermined temperature condition in the rollers, and means for selectively feeding to the fountain roller and reciprocating roller a shot of high temperature fluid and a shot of low temperature fluid thereby to bring the temperature of the rollers rapidly to the desired temperature and for thereafter turning over control of the temperature to the regulator.

3. The combination as claimed in claim 2 in which separate monitoring thermometers are provided in the return lines at the outlets of the fountain roller and the vibrated roller.

4. In an inking system for applying ink to a printing plate in a printing press, the combination comprising a fountain including a fountain roller, a series of ink feed rollers including at least one vibrated roller, the fountain roller and vibrated roller being of hollow metallic construction having supply and return lines for circulation of fluid therethrough, a fountain roller fluid reservoir and a vibrated roller fluid reservoir coupled to the respective supply and return lines, each of the reservoirs having alternatively energizable sources of heat and cold and separate regulator means responsive to the temperatures of the fluid for correctively energizing the sources of heat and cold thereby to maintain the fountain roller and vibrated roller at respective equilibrium temperatures.

5. The combination as claimed in claim 4 in which the separate regulator means are responsive to the temperatures of the fluid in the respective return lines.

6. The combination as claimed in claim 4 in which auxiliary hot and cold reservoirs are provided together with valve means for furnishing to the fountain roller and vibrated roller selectively a shot of hot or cold fluid from the reservoirs to achieve the desired equilibrium temperature at an accelerated rate, following which control is restored to the regulators.

7. In an inking system for applying ink to a printing plate in a printing press, the combination comprising a fountain including a fountain roller, a series of ink feed rollers including at least one vibrated roller, the fountain roller and vibrated roller being of hollow metallic construction having fluid supply and return lines, a fluid reservoir having an alternatively energizable source of heat and source of cold, a pump for pumping fluid through the supply and return lines, regulator means for correctively energizing the source of heat and source of cold to maintain a predetermined temperature condition in the rollers, and means for shutting off the pump in response to a drop in the speed of the associated press and for starting up the pump upon resumption of operating speed.

8. The combination as claimed in claim 7 in which the shut off means responsive to press speed includes a tachometer generator having an associated control device connected controllingly to the pump.

9. In an inking system for applying ink to a printing plate in a printing press, the combination comprising a fountain including a fountain roller, a series of ink feed rollers including at least one vibrated roller, means for automatically regulating the temperature of the fountain roller thereby to maintain constant the amount of ink fed from the fountain for maintenance of a predetermined density of ink in the full tone areas of the plate, means for automatically regulating the temperature of the vibrated roller thereby to maintain constant the printing contrast in the half tone areas of the printing plate over long press runs and notwithstanding wide variations in ambient temperature, the regulating means including both a source of heat and a source of cold with means for correctively actuating the sources, and means for disabling the regulating means as long as the press is operating at substantially less than operating speed.

10. In an inking system for applying ink to a printing plate in a printing press, the combination comprising a fountain roller and a vibrated roller, at least one of the rollers being of hollow metallic construction having a fluid supply line and a fluid return line, a reservoir and pump connected in series with the supply and return lines to establish a circulating loop, a source of heat in the reservoir and a source of cold in the reservoir, regulator means responsive to the temperature in the loop for correctively activating one of the sources so that the temperature in the associated roller and in the ink film thereon is maintained constant at a desired level in spite of changes in operating and ambient conditions, auxiliary sources of cold fluid and heated fluid, and a selector valve for connecting such auxiliary sources to the lines to achieve the desired temperature at an accelerated rate following which fluid is supplied from the reservoir at the regulated temperature.

11. In an inking system for applying ink to a printing plate in a printing press, the combination comprising a fountain including a fountain roller, a series of ink feed rollers including at least one vibrated roller, the fountain roller and vibrated roller being of hollow metallic construction having fluid supply and return lines, a fluid reservoir having an alternatively energizable source of heat and source of cold, a pump for pumping fluid through the supply and return lines, and regulator means for correctively energizing the source of heat and source of cold to maintain the temperature in the rollers at a predetermined level, auxiliary reservoirs of cold and heated fluid, and manual selector valve means for selectively connecting the reservoirs to the lines.

12. The combination as claimed in claim 11 in which separate pumps are associated with each of the reservoirs with means for separately energizing the pumps.

13. The combination as claimed in claim 11 in which separate selector valves are provided in the supply and return lines.

14. In an inking system for applying ink to a printing plate in a printing press, the combination comprising a fountain roller and a vibrated roller, the fountain roller having a fountain blade, each of the said rollers being of hollow metallic construction having a fluid supply line and a fluid return line, reservoir means and pump means connected in series with the supply and return lines to establish circulating flow, a source of heat in the reservoir means and a source of cold in the reservoir means, the source of heat being in the form of a thermal heating element and the source of cold being in the form of a refrigeration unit intimately coupled to the fluid in the reservoir, and regulator means responsive to the temperature in the return lines for correctively and alternatively activating one of the sources, thereby tending to maintain constant the temperature in the return lines so that the temperature in the fountain roller and vibrated roller is maintained constant at a desired level in spite of changes in operating conditions and in spite of wide upward and downward variations in ambient temperature, with maintenance of temperature in the fountain insuring that the amount of ink fed past the fountain blade will remain constant and with maintenance of temperature at the vibrated roller insuring that the printing contrast remains constant at the half tone areas of the printing plate.

15. The combination as claimed in claim 14 in which means are provided for producing an output signal which varies in accordance with the speed of the press, and means responsive to the output signal for (*a*) turning off the pump means when the press speed goes to a cut-off level substantially below operating speed and (*b*) turning on the pump means again automatically when the press speed is restored to a speed above the cut-off level.

* * * * *